US007762791B2

(12) United States Patent
Cai et al.

(10) Patent No.: US 7,762,791 B2
(45) Date of Patent: Jul. 27, 2010

(54) CONSTRUCTION IMPROVEMENT OF THE PISTON VALVE IN COMPRESSING PUMP

(76) Inventors: Ying Lin Cai, 402, No. 6, Yeong Feng Chih Street, Rong Chi Town, Shunde County, Guangdong (CN); Chao Fou Hsu, 9Fl., No. 16, Lane 417, Huangshing Rd., Sanmin Chiu, Kaohsiung (TW) 807

( * ) Notice: Subject to any disclaimer, the term of this patent is extended or adjusted under 35 U.S.C. 154(b) by 854 days.

(21) Appl. No.: 11/258,027

(22) Filed: Oct. 26, 2005

(65) Prior Publication Data

US 2006/0090642 A1 May 4, 2006

(30) Foreign Application Priority Data

Oct. 27, 2004 (CN) ..... 2004 1 0090237X

(51) Int. Cl.
*F04B 1/12* (2006.01)
*F04B 27/08* (2006.01)
*F04B 1/26* (2006.01)

(52) U.S. Cl. ..... 417/269; 417/270

(58) Field of Classification Search ..... 417/269, 417/307, 533, 569
See application file for complete search history.

(56) References Cited

U.S. PATENT DOCUMENTS 4,610,605 A * 9/1986 Hartley ..... 417/269
5,203,803 A * 4/1993 Schoenmeyr ..... 417/38
5,476,367 A * 12/1995 Zimmermann et al. ..... 417/307
5,571,000 A * 11/1996 Zimmermann et al. ..... 417/307
5,626,464 A * 5/1997 Schoenmeyr et al. ..... 417/269
5,632,607 A * 5/1997 Popescu et al. ..... 417/415
5,791,882 A * 8/1998 Stucker et al. ..... 417/269
5,800,136 A * 9/1998 Kurth et al. ..... 417/311
5,980,210 A * 11/1999 Tseng ..... 417/38
6,048,183 A * 4/2000 Meza ..... 417/569
6,623,245 B2 * 9/2003 Meza et al. ..... 417/44.1
6,840,745 B1 * 1/2005 Macauley et al. ..... 417/269

* cited by examiner

*Primary Examiner*—Charles G Freay
*Assistant Examiner*—Alexander B Comley
(74) *Attorney, Agent, or Firm*—Bacon & Thomas, PLLC

(57) ABSTRACT

In a piston valve in a compressing pump, a discharge base formed in the center of the piston valve has a planar shape having discharge spouts formed corresponding with each inlet slots. A 3-bladed anti-backflow plastic gasket covers the top of the discharge base such that each blade can block corresponding discharge spouts. As wobble wheels of the compressing pump push the diaphragm in turns, the water flow from each said inlet slot at each area will continuously run into each discharge spout at each area in said discharge base in turn so that each blade of the gasket moves up and down in turn as well, to achieve an open-and-shut effect of the discharge spouts. Therefore, drawbacks of leakage, pressure loss, or failure can be prevented, and the serving life of the gasket can be prolonged, improving the compressing and discharging efficiency of the pump.

1 Claim, 7 Drawing Sheets

CONSTRUCTION IMPROVEMENT OF THE PISTON VALVE IN COMPRESSING PUMP

FIELD OF THE PRESENT INVENTION

The present invention relates to the discharge of the piston valve in compressing pump exclusively used in the reverse osmosis purification; more particularly a construction improvement being contrived to prevent the drawback of said compressing pump from leakage and pressure failure or loss.

BACKGROUND OF THE PRESENT INVENTION

Refer to FIG. 1 through FIG. 6, a conventional compressing pump exclusively used in the reverse osmosis purification comprises: a motor 10 with an upper hood chassis 11 being built on the output shaft (not shown in the figure) of said motor 10, and multiple screw bores 12 are perforated on the peripheral of said upper hood chassis 11; a plurality of wobble wheels 13, which are movably placed in said upper hood chassis 11, are drived by the output shaft of said motor 10 such that being transformed into radial reciprocating motion; a diaphragm 20 covers on said upper hood chassis 11; a piston valve 30 is embedded in said diaphragm 20; an anti-backflow plastic gasket 40 and an upper hood 50 are closely stuck on said piston valve 30; By means of bolts 2 driving through said multiple screw bores 12 on said upper hood chassis 11 and corresponding perforated bores 51 being preset on said upper hood 50, said conventional compressing pump is assembled (as shown in the FIG. 6).

Wherein, a seal groove 21 is rimed on said diaphragm 20; some convex humps 22, which are respectively set in corresponding with each wobble wheel 13, have some piston pushers 23 are stacked on each top of their own; a perforated bore 231 being punched on each said piston pushers 23 and a perforated bore 221 being punched on each said convex humps 22 are coaxial to be driven by each screw 24 so that each said piston pushers 23 and said diaphragm 20 can be securely screwed on each said wobble wheel 13 (as shown in the FIG. 4), thus each said piston pushers 23 and said diaphragm 20 together with each said wobble wheel 13 can radially reciprocate synchronously (as hypothetical dash line shown in the FIG. 4).

Refer to FIG. 2 and FIG. 4 to FIG. 6, a discharge base 31, which is concaved at the center of said piston valve 30 with bowl-shape direction towards said upper hood 50, has an orientating hole 32 punched at its center; three separating grooves 33 are radially indented around said orientating hole 32 with 120 degree included angle one another; some discharge spouts 34 are punched on the area in between each said groove 33; some inlet slots 35, which are punched around the peripheral of said discharge base 31 in corresponding with each said discharge spouts 34, has some inverse flare piston slice 36 punched at each center of their own so that to block each said corresponding inlet slots 35; Said anti-backflow plastic gasket 40, which is bowl-shape unitary-molded integral resilient soft material, is closely stuck on the top surface of said discharge base 31 in said piston valve 30 with an orientating stem 41 projecting at its bottom center and with three separating rib panels 42 are radially indented at the top around center axis with 120 degree included angle one another; a projecting panel 43 is respectively protruded on the peripheral corresponding to each said rib panel 42; Synchronously inserting said orientating stem 41 into said orientating hole 32 on said discharge base 31 and insetting each said projecting panel 43 into each corresponding said separating groove 33, the entire outer hemispherical surface of said integral anti-backflow plastic gasket 40 can closely stick and block with said discharge spouts 34 on said discharge base 31 (as shown in the FIG. 4); wherein, an inlet chamber 3 is created among said anti-backflow plastic gasket 40 and each said discharge spout 34 on said discharge base 31 as well as each said piston pusher 23 on said diaphragm 20 such that one of its end in connection with said inlet slot 35 (as shown in the FIG. 6).

Said upper hood 50, in which an inlet orifice 52 and an outlet orifice 53 as well as some perforated bores 51 are built on its outer surface (as shown in the FIG. 2 and FIG. 6), has a ramp groove 54 indented on the inner rim of its bottom so that the outer rim of the integral body, which is combined by stacking said diaphragm 20 with said piston valve 30, can be closely stuck with said ramp groove 54; An annular groove 55, which is built in the internal center of said upper hood 50, has its bottom strained against the outer rim of said discharge base 31 on said piston valve 30 so that a compressed chamber 4 is encompassed by the inner wall of said annular groove 55 and discharge base 31 on said piston valve 30 (as shown in the FIG. 6).

Refer to FIG. 7, the tap-water W, which first flows through said inlet orifice 52 on said upper hood 50 and next passes said inlet slot 35 on said piston valve 30, flows into said inlet chamber 3 for being compressed; Under radially reciprocating motion of said to said wobble wheels 13, said piston pushers 23 will simultaneously squeeze the tap-water W in said inlet chamber 3 up to 80 psi~100 psi; The compressed tap-water W, which is enabled to run into said compressed chamber 4 by way of said discharge spout 34 on said discharge base 31, is discharged out of the compressing pump through said outlet orifice 53 on said upper hood 50, and then flows into filtering membrane tube of the reverse osmosis water purification apparatus for reverse osmosis filtration (not shown in the figures). However, there are some substantial drawbacks in the foregoing procedure as below:

Because said bowl-shaped anti-backflow plastic gasket 40 on said piston valve 30 is contrived to cover each said discharge spout 34 in order to function open-and-shut by turns, the displacement will be limited due to resilience fatigue after the reverse osmosis compressing pump has served for a period of time; hence, it not only affects the discharge efficiency but also the open-and-shut timing; thus, the total discharge efficiency of said compressing pump will be decreased in consequence of reducing shut effect of said anti-backflow plastic gasket 40 corresponding each adjacent said discharge spout 34; the longer aging effect of the compressing pump will increase the more of its distortion δ (as shown in the FIG. 3); eventually, the shut effect of said discharge spout 34 fails entirely, thus the total quantity of the output water and the total output pressure is vitally decreased; that is the main reason why the discharge quantity being decreased and the output pressure being lost or failed after a period in serving time (about 3 months to 6 months) of the conventional compressing pump.

SUMMARY OF THE PRESENT INVENTION

The primary object of the present invention is to provide a construction improvement of the piston valve in compressing pump, wherein the discharge base, which is built in the center of the piston valve, has a planar shape. An anti-backflow plastic gasket, is configured in a 3-blade planar shape to entirely cover said discharge base, and has a gap cleft created between each blade so that each said blade can closely block exactly a corresponding group of discharge spouts on said discharge base respectively. By means of a gap cleft created between each blade, each said blade is flexibly enabled to act smoothly during the procedure of constant alternate open-and-shut discharge without any interference each other. As a result, drawbacks of leakage and pressure loss or failure can be avoided as the distortion of each said blade will never happen again; thus not only the serving life of said anti-backflow plastic gasket can be prolonged, but also the compressing and discharging efficiency of integral compressing pump can be further enhanced.

DETAILED DESCRIPTION OF THE PREFERRED EMBODIMENTS

Figure 1:
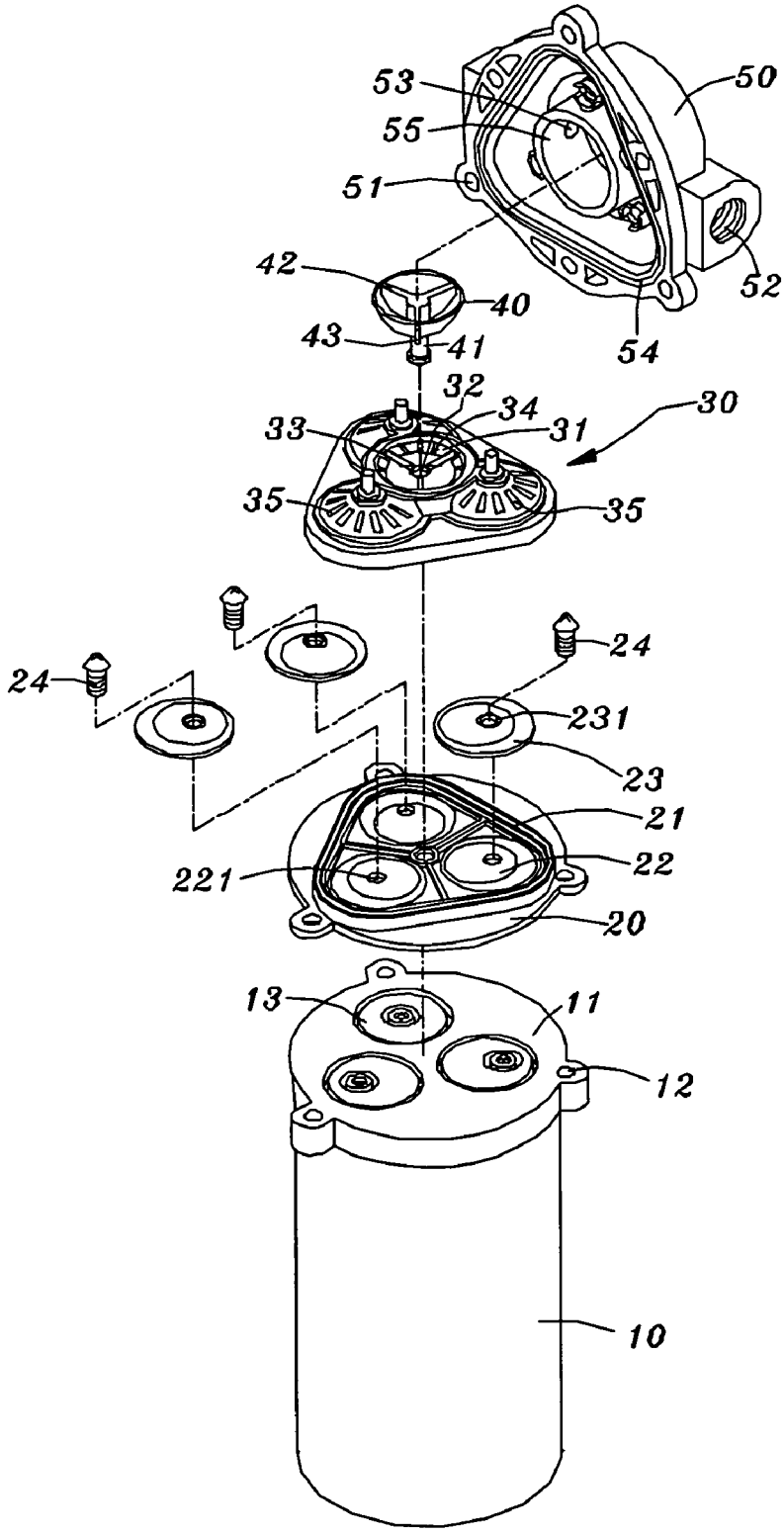
FIG. 1 (PRIOR ART)
FIG. 1 is an exploded perspective view of conventional compressing pump.
Figure 2:
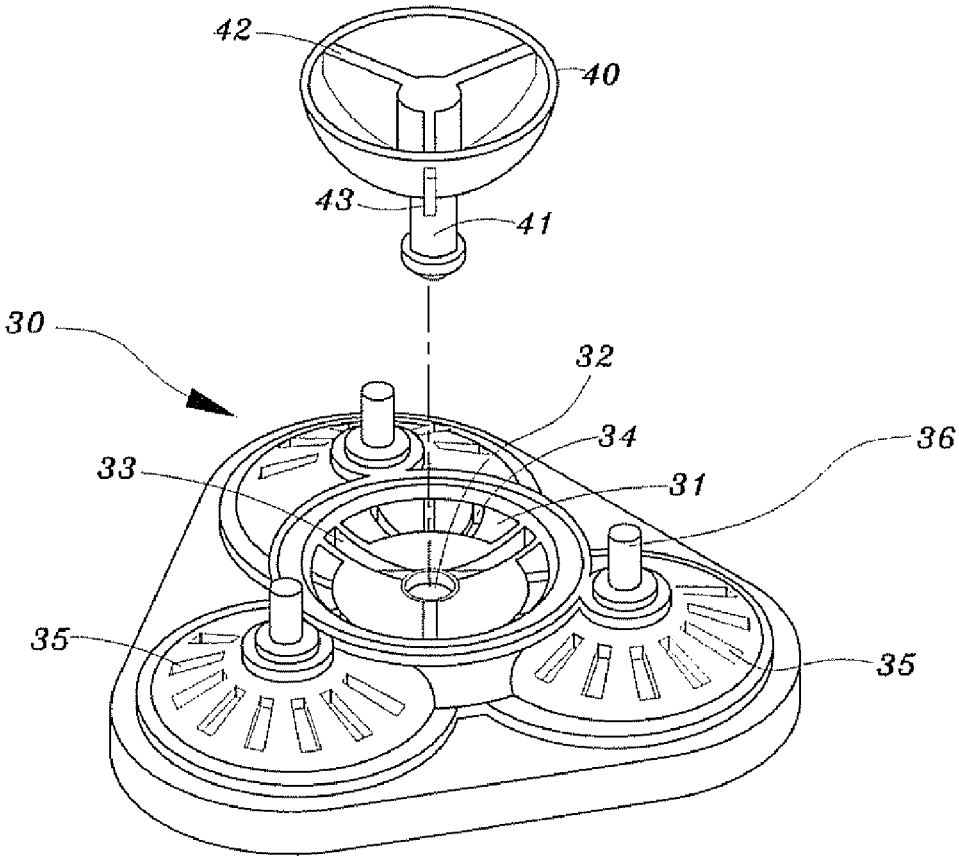
FIG.2 (PRIOR ART)
FIG. 2 is an exploded perspective view of the conventional piston valve and anti-backflow plastic gasket.
Figure 3:
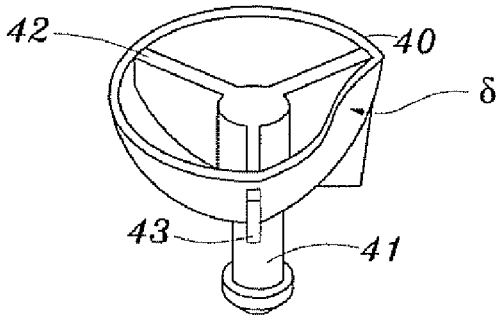
FIG.3 (PRIOR ART)
FIG. 3 is a perspective illustrative view of the conventional anti-backflow plastic gasket in distortion.
Figure 4:
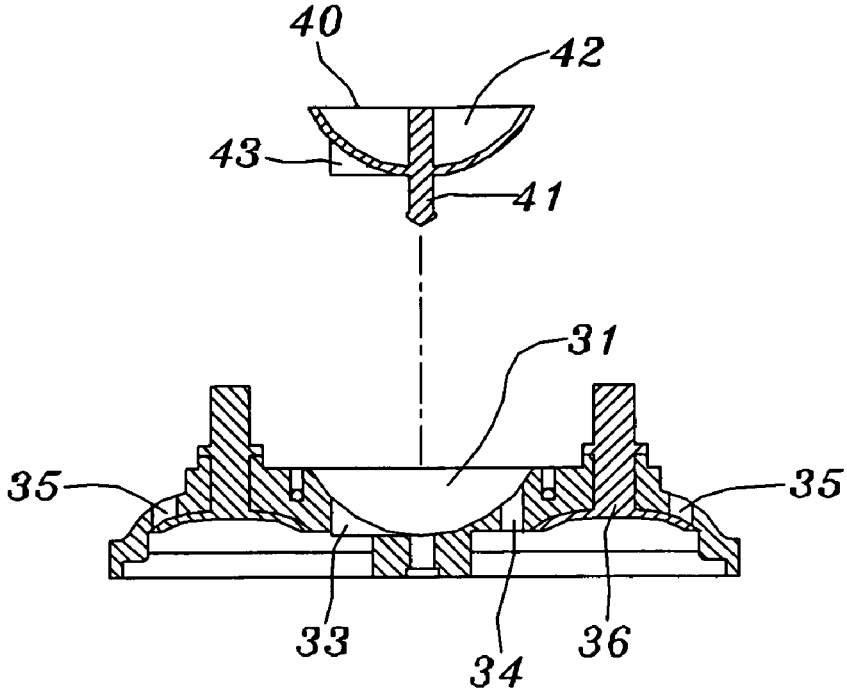
Fig. 4 (PRIOR ART)
FIG. 4 is an exploded sectional view of the conventional piston valve and anti-backflow plastic gasket.
Figure 5:
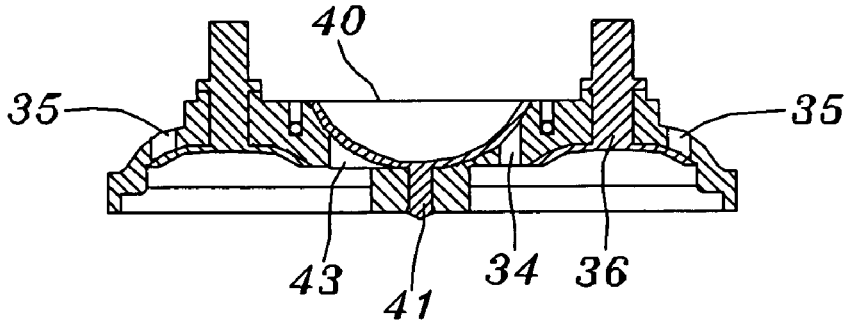
Fig. 5 (PRIOR ART)
FIG. 5 is a sectional view in assembly of the conventional piston valve and anti-backflow plastic gasket.
Figure 6:
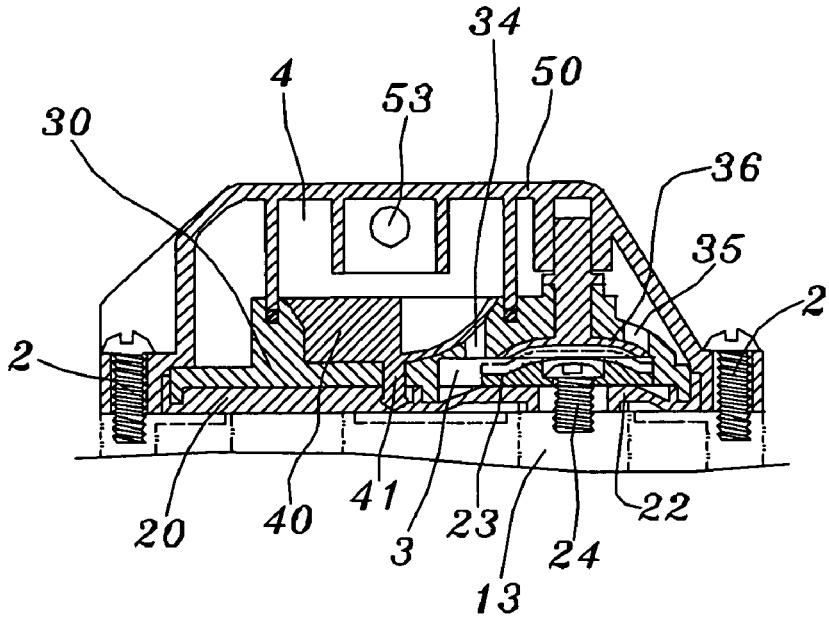
Fig.6 (PRIOR ART)
FIG. 6 is a partial sectional view in assembly of the conventional piston valve and upper hood.
Figure 7:
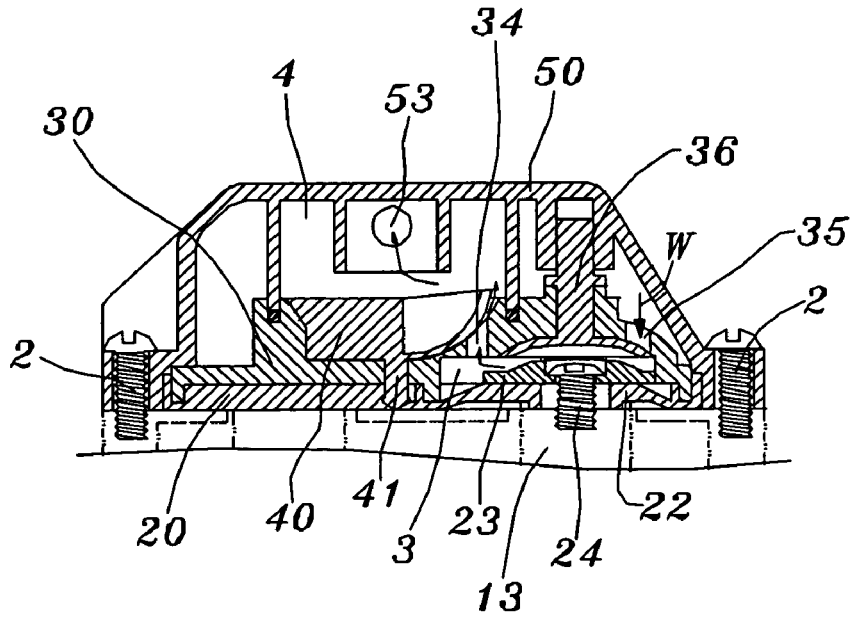
Fig.7 (PRIOR ART)
FIG. 7 is the functional view of the FIG. 6.
Figure 8:
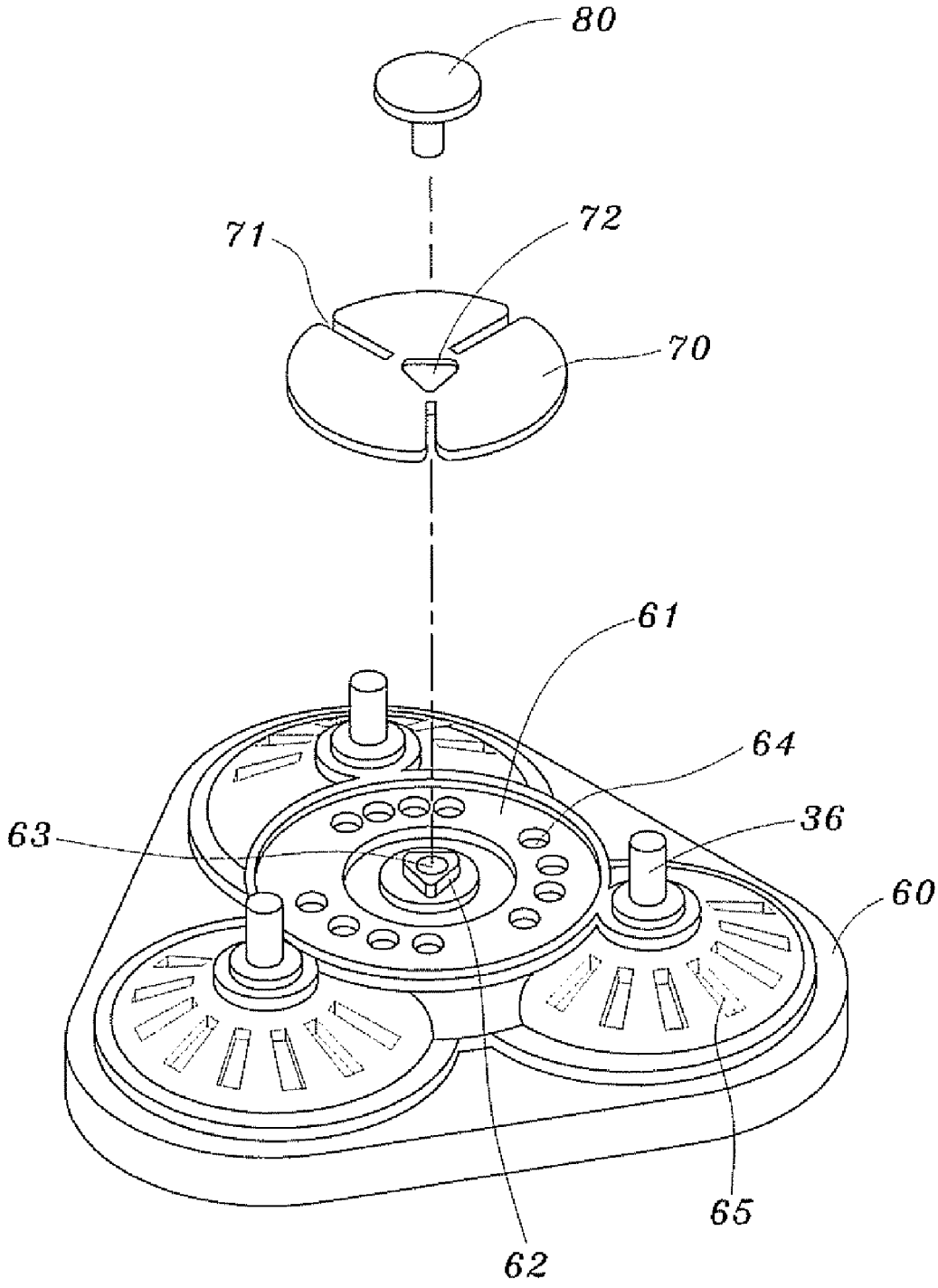
FIG. 8 is an exploded perspective view of the present invention.
Figure 9:
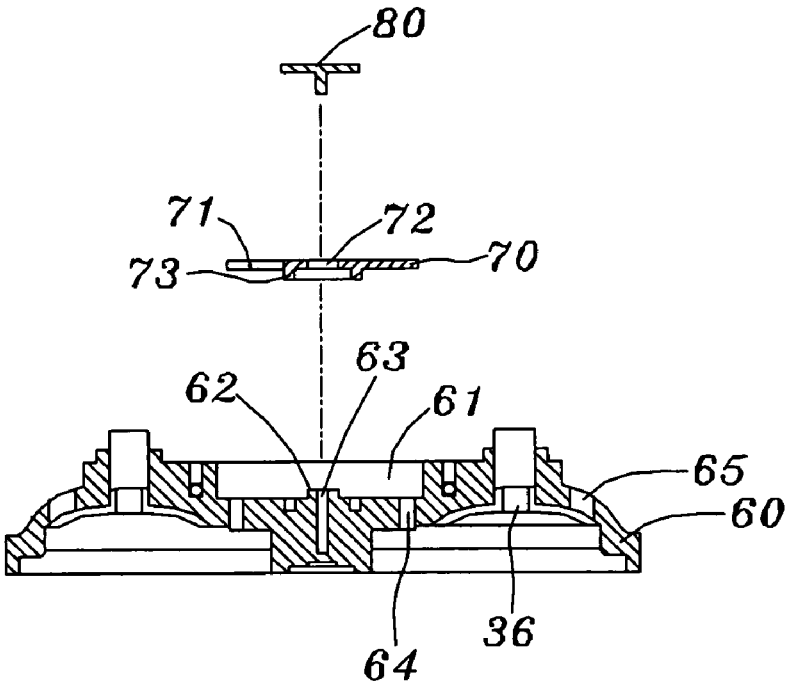
FIG. 9 is an exploded sectional view of the present invention.
Figure 10:
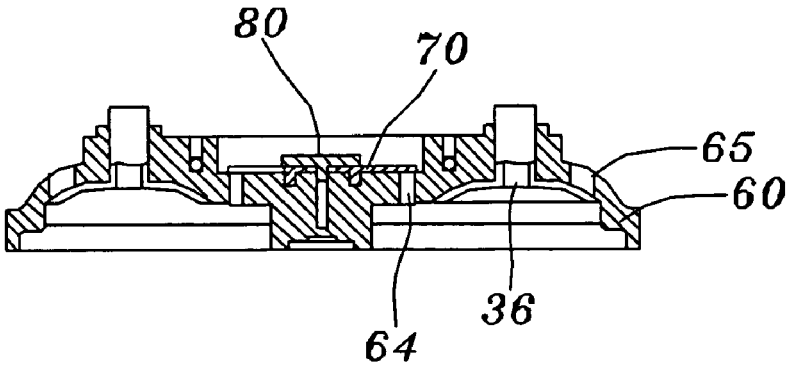
FIG. 10 is a sectional view in assembly of the present invention.

Referring to FIG. 8 to FIG. 10, a construction improvement of the piston valve in a compressing pump of the present invention comprises a piston valve and a anti-backflow plastic gasket. The discharge base 61, which is built in the center of the piston valve 60 of the compressing pump with direction towards the upper hood 50, is formed in a planar shape. An orientating lump 62, which is created in the top center of said discharge base 61 and has an orientating hole 63 punched at its center, has some discharge spouts 64 punched in each of three areas spaced generally 120 degrees apart on centers. A plurality of inlet slots 65, which are created on the peripheral of said discharge base 61 corresponding with said three areas of the discharge spouts 64, each has some inverse flare piston slice 36 punched at its center so that to block each said corresponding inlet slots 65. The anti-backflow plastic gasket 70 is configured in a 3-blade planar shape to entirely cover said discharge base 61. The 3-blade planar shape has a gap cleft 71 created between each blade so that each said blade can closely block exactly the corresponding discharge spouts 64 on said discharge base 61 respectively. An orientating aperture 72, which is punched at the center of said anti-backflow plastic gasket 70, has an orientating ring 73 protruding downwards from its bottom. The assembly procedure is as follows: By aligning said orientating ring 73 on said anti-backflow plastic gasket 70 with said discharge base 61, sleeving said orientating aperture 72 with said orientating lump 62 on the center of said discharge base 61 in said piston valve 60, and then inserting the tack-typed orientating shaft 80 into said orientating hole 63 on said orientating lump 62, the assembly of said anti-backflow plastic gasket 70 and said piston valve 60 is properly accomplished.

Figure 11:
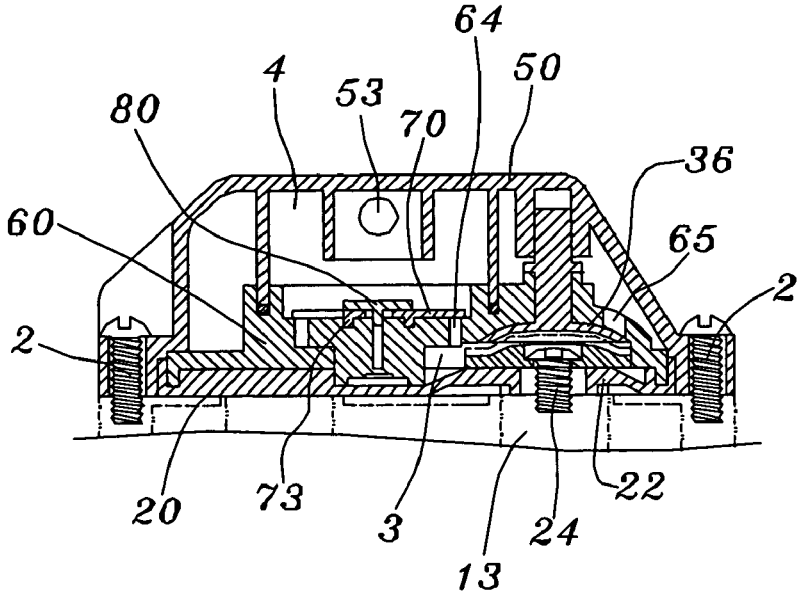
FIG. 11 is a partial sectional view in assembly of the present invention and upper hood.
Figure 12:
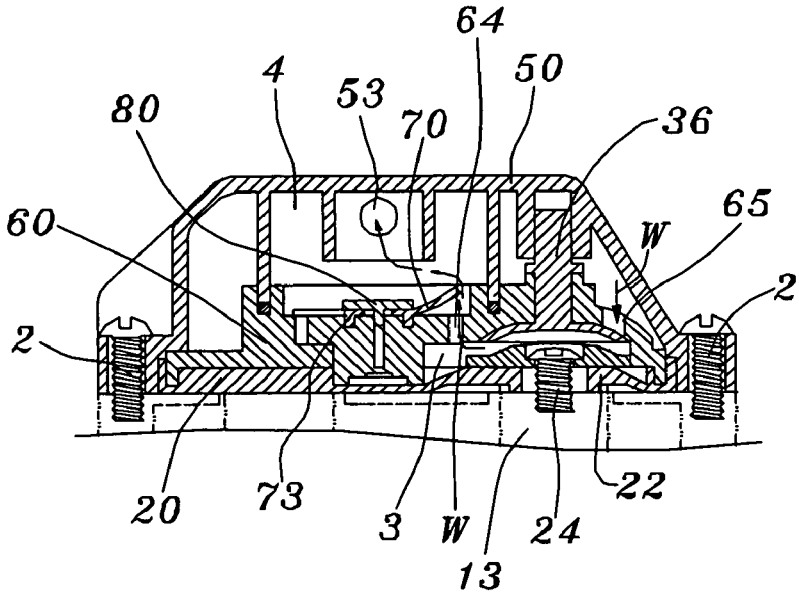
FIG. 12 is the functional view of the FIG. 11.

Referring to FIG. 11 and FIG. 12, as each of the wobble wheels 13 of the compressing pump pushing said diaphragm 20 in turn, the operation proceeds as follows. The tap-water W, which first flows through said inlet orifice 52 on said upper hood 50 and next passes said inlet slot 65 on said piston valve 60, flows into said inlet chamber 3 for being compressed. Under radially reciprocating motion of the wobble wheels 13, said piston pushers 23 will simultaneously squeeze the tap-water W in said inlet chamber 3 up to 80 psi~100 psi. The compressed tap-water W can flush through each blade on said anti-backflow plastic gasket 70 then flow into said compressed chamber 4 by way of said discharge spout 64, and be discharged out of the compressing pump through said outlet orifice 53 on said upper hood 50. Hence, the water flow, coming from each said inlet slot 65 at each area, will continuously run into each said discharge spout 64 at each area in said discharge base 61 by turns so that each blade on said anti-backflow plastic gasket 70 moves in an up-and-down (open-and-shut) action in turn as well, thus achieving the open-and-shut effect of each said discharge spout 64 at each area. Therefore, drawbacks of leakage, pressure loss, or failure can be prevented, and the serving life of the gasket 70 can be prolonged, improving the compressing and discharging efficiency of the pump.

What is claimed is:

1. A construction improvement of a piston valve in a compressing pump, comprising:

a piston valve and a anti-backflow plastic gasket;

a planar discharge base built in the center of the piston valve of the compressing pump facing towards an upper hood;

an orientating lump, disposed in the top center of said discharge base and having an orientating hole punched at its center, a plurality of discharge spouts punched in each of three areas of said discharge base, the areas being spaced generally 120 degrees apart;

three groups of inlet slots, which are created on the peripheral of said discharge base corresponding with said three areas of the discharge spouts, each having an inverse flare piston slice punched at its center;

the anti-backflow plastic gasket being configured in a 3-blade planar shape to entirely cover the top of said discharge base and having a gap cleft created between each blade so that each said blade can closely block exactly a corresponding group of discharge spouts on said discharge base respectively;

an orientating aperture being punched at the center of said anti-backflow plastic gasket having an orientating ring protruding downwards from its bottom;

wherein by aligning said orientating ring on said anti-backflow plastic gasket with said discharge base, sleeving said orientating aperture with said orientating lump on the center of said discharge base in said piston valve, and inserting a tack-typed orientating shaft into said orientating hole on said orientating lump, said anti-backflow plastic gasket and said piston valve are securely assembled.

* * * * *